US008464797B2

(12) United States Patent
Singh et al.

(10) Patent No.: US 8,464,797 B2
(45) Date of Patent: Jun. 18, 2013

(54) SUBSEA CONTROL MODULE WITH REMOVABLE SECTION AND METHOD

(75) Inventors: Hardev Singh, San Antonio, TX (US); David Dietz, Jr., Tomball, TX (US); Luis Melendez, Humble, TX (US); Dat Nguyen, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 470 days.

(21) Appl. No.: 12/816,912

(22) Filed: Jun. 16, 2010

(65) Prior Publication Data

US 2011/0265885 A1 Nov. 3, 2011

Related U.S. Application Data

(60) Provisional application No. 61/329,883, filed on Apr. 30, 2010.

(51) Int. Cl.
*E21B 33/076* (2006.01)
*E21B 33/035* (2006.01)

(52) U.S. Cl.
USPC ..... 166/340; 166/344; 166/365

(58) Field of Classification Search
USPC ..... 137/236.1; 166/338, 339, 340, 344, 166/351, 365, 368
See application file for complete search history.

(56) References Cited

U.S. PATENT DOCUMENTS 3,865,142 A * 2/1975 Begun et al. ..... 137/236.1
3,894,560 A * 7/1975 Baugh ..... 137/236.1
3,921,500 A * 11/1975 Silcox ..... 166/338
4,328,826 A * 5/1982 Baugh ..... 137/236.1
4,404,989 A * 9/1983 LeMoine ..... 137/236.1
4,444,218 A * 4/1984 Baugh ..... 137/236.1
5,070,904 A * 12/1991 McMahon et al. ..... 137/1
5,398,761 A 3/1995 Reynolds et al.
6,032,742 A * 3/2000 Tomlin et al. ..... 166/365
6,068,427 A 5/2000 Ostergaard
6,161,618 A 12/2000 Parks et al.
6,484,806 B2 11/2002 Childers et al.
6,622,799 B2 9/2003 Dean
6,644,410 B1 11/2003 Lindsey-Curran et al.
6,938,695 B2 9/2005 Williams
7,216,714 B2 5/2007 Reynolds
7,216,715 B2 5/2007 Reynolds
7,222,674 B2 5/2007 Reynolds
7,690,433 B2 4/2010 Reynolds
2004/0154804 A1* 8/2004 Williams ..... 166/345
2009/0038805 A1 2/2009 Parks et al.
2009/0194290 A1 8/2009 Parks et al.
2012/0132436 A1* 5/2012 Judge ..... 166/363

* cited by examiner

*Primary Examiner* — John Rivell
(74) *Attorney, Agent, or Firm* — Bracewell & Giuliani LLP

(57) ABSTRACT

A method for assembling a control module having a fixed part and a removable section. The method includes configuring the fixed part of the control module to be attached to a pressure supply line for receiving a fluid under pressure; providing in the fixed part a valve manifold that houses a hydraulic activated valve; detachably attaching the removable section of the control module to the fixed part; fluidly connecting an electrically activated valve of the removable section to the hydraulic activated valve such that the electrically activated valve controls the hydraulic activated valve; and configuring the electrically activated valve to electrically connect to a control section.

15 Claims, 18 Drawing Sheets

SUBSEA CONTROL MODULE WITH REMOVABLE SECTION AND METHOD

CROSS REFERENCE TO RELATED APPLICATIONS

This application claims priority and benefit from Provisional Patent Application No. 61/329,883, filed Apr. 30, 2010, for "Subsea Control Module with Removable Section and Method", the entire contents of which are incorporated herein by reference.

BACKGROUND

1. Technical Field

Embodiments of the subject matter disclosed herein generally relate to methods and systems and, more particularly, to mechanisms and techniques for removing and/or replacing a section of a subsea control module.

2. Discussion of the Background

Subsea oil and gas exploration becomes more challenging as the exploration depth increases. Complex devices are disposed on the ocean floor for extracting the oil and for the safety of the oil equipment and the environment. These devices have to withstand, among other things, high pressures (from 3,000 to 60,000 psi (200 to 4000 bar) or more) and highly corrosive conditions. Although precautions are taken when building these devices, component parts of these devices wear out with time and need to be replaced.

As these parts are disposed on the ocean floor (sometimes more than 2000 m below sea level) and sometimes are provided inside larger components, access to them may be problematic. For example, FIG. 1 illustrates a lower blowout preventer stack ("lower BOP stack") 10 that may be rigidly attached to a wellhead 12 upon the sea floor 14, while a Lower Marine Riser Package ("LMRP") 16 is retrievably disposed upon a distal end of a marine riser 18, extending from a drill ship 20 or any other type of surface drilling platform or vessel. As such, the LMRP 16 may include a stinger 22 at its distal end configured to engage a receptacle 24 located on a proximal end of the lower BOP stack 10.

In typical configurations, the lower BOP stack 10 may be rigidly affixed atop the subsea wellhead 12 and may include (among other devices) a plurality of ram-type blowout preventers 26 useful in controlling the well as it is drilled and completed. The flexible riser provides a conduit through which drilling tools and fluids may be deployed to and retrieved from the subsea wellbore. Ordinarily, the LMRP 16 may include (among other things) one or more ram-type blowout preventers 28 at its distal end, an annular blowout preventer 30 at its upper end, and a MUX pod (in reality two, which are referred to in the industry as blue and yellow pods) 32.

When desired, the ram-type blowout preventers of the LMRP 16 and the lower BOP stack 10 may be closed and the LMRP 16 may be detached from the lower BOP stack 10 and retrieved to the surface, leaving the lower BOP stack 10 atop the wellhead. Thus, for example, it may be necessary to retrieve the LMRP 16 from the wellhead stack in times of inclement weather or when work on a particular wellhead is to be temporarily stopped.

Also, when a part of the LMRP 16 fails, the entire LMRP 16 may need to be raised on the ship 20 for repairs and/or maintenance. One such part that may require maintenance from time to time is the MUX pod 32. A conventional MUX pod system 40, is shown in FIG. 2 and may provide between 50 and 100 different functions to the lower BOP stack and/or the LMRP and these functions may be initiated and/or controlled from or via the LMRP.

The MUX pod 40 is fixedly attached to a frame (not shown) of the LMRP and may include hydraulically activated valves 50 (called in the art sub plate mounted (SPM) valves) and solenoid valves 52 that are fluidly connected to the hydraulically activated valves 50. The solenoid valves 52 are provided in an electronic section 54 and are designed to be actuated by sending an electrical signal from an electronic control board (not shown). Each solenoid valve 52 is configured to activate a corresponding hydraulically activated valve 50. The MUX pod 40 may include pressure sensors 56 also mounted in the electronic section 54. The hydraulically activated valves 50 are provided in a hydraulic section 58 and are fixedly attached to the MUX pod 40 (i.e., a ROV vehicle cannot remove them when the same is disposed on the seafloor).

In typical subsea blowout preventer installations, multiplex ("MUX") cables (electrical) and/or lines (hydraulic) transport control signals (via the MUX pod and the pod wedge) to the LMRP 16 and lower BOP stack 10 devices so specified tasks may be controlled from the surface. Once the control signals are received, subsea control valves are activated and (in most cases) high-pressure hydraulic lines are directed to perform the specified tasks. Thus, a multiplexed electrical or hydraulic signal may operate a plurality of "low-pressure" valves to actuate larger valves to communicate the high-pressure hydraulic lines with the various operating devices of the wellhead stack.

A bridge between the LMRP 16 and the lower BOP stack 10 is formed that matches the multiple functions from the LMRP 16 to the lower BOP stack 10, e.g., fluidly connects the SMP valves 50 from the MUX pod provided on the LMRP to dedicated components on the BOP stack or the LMRP. The MUX pod system is used in addition to choke and kill line connections (not shown) or lines that ensure pressure supply to, for example, the shearing function of the BOPs.

The bridge is shown in FIG. 3 and may include a pod wedge 42 configured to engage a receiver 44 on the BOP stack. The pod wedge 42 has plural holes (not shown), depending on the number of functions provided, that provide various hydraulic and/or electrical signals from the LMRP 16 to the lower BOP stack 10. However, it is noted that the pod wedge 42 is designed with a given number of functions (holes) and after being deployed, the MUX pod system cannot be modified to handle more functions.

Examples of communication lines bridged between LMRPs and lower BOP stacks through feed-thru components include, but are not limited to, hydraulic choke lines, hydraulic kill lines, hydraulic multiplex control lines, electrical multiplex control lines, electrical power lines, hydraulic power lines, mechanical power lines, mechanical control lines, electrical control lines, and sensor lines. In certain embodiments, subsea wellhead stack feed-thru components include at least one MUX pod connection whereby a plurality of hydraulic control signals are grouped together and transmitted between the LMRP 16 and the lower BOP stack 10 in a single monoblock feed-thru component as shown, for example, in FIG. 3.

In conventional MUX pods, when one or more of the solenoid valves 52 or any of the various other instruments and components require service or replacement, which happens from time to time, the whole MUX pod 40 has to be brought to the surface. However, as the MUX pod 40 is bolted to the LMRP, it is necessary that the entire LMRP be brought to the surface for repair. This operation is disrupting for the functioning of the well as the drilling or oil extraction has to be stopped, which involves production losses. In addition, the size and weight of the MUX pod 40 and the LMRP are large (sometimes in the range of tens to hundreds of tons), which makes the entire retrieval process not only time consuming but dangerous.

An approach to limit the disruption of oil extraction has been presented in U.S. Pat. No. 7,216,714 to G. Reynolds, the entire disclosure of which is incorporated here by reference. U.S. Pat. No. 7,216,714 uses a control module 60 (shown in FIG. 4, which corresponds to FIG. 5 of U.S. Pat. No. 7,216,714) that combines a pilot valve (solenoid valve) 62 with a hydraulically activated valve 64, both disposed in a single casing 66. The control module 60 has a connector 68 that connects to a receiver 70 that is fixedly attached to the BOP stack. Thus, when the pilot valve 62 fails, the entire control module 60 may be detached from receiver 70 and brought to the surface for repair by use of a Remotely Operated Vehicle (ROV). In this way, the BOP stack remains on the well head. This process minimizes the down time of the oil rig.

However, this process is still cumbersome as both the hydraulically activated valve and the solenoid valve need to be removed and brought to the surface. Once there, the control module 60 has to be disassembled and only the failed part replaced with a new part. However, the weight and size of the control module may be significant, thus imposing considerable power requirements on the ROV vehicle. Another disadvantage of the existing devices is that most of the time there is no need to bring to the surface the SPM valves as these valves are more reliable than the electro-hydraulic valves. Accordingly, it would be desirable to provide systems and methods that are faster and simpler than the afore-described approaches.

SUMMARY

According to one exemplary embodiment, there is a method for assembling a control module having a fixed part and a removable section. The method includes configuring the fixed part of the control module to be attached to a pressure supply line for receiving a fluid under pressure; providing in the fixed part a valve manifold that houses a hydraulic activated valve; detachably attaching the removable section of the control module to the fixed part; fluidly connecting an electrically activated valve of the removable section to the hydraulic activated valve such that the electrically activated valve controls the hydraulic activated valve; and configuring the electrically activated valve to electrically connect to a control section.

According to still another exemplary embodiment, there is a method for assembling a control module having a fixed part and a removable section. The method includes connecting a first base to a valve manifold that houses a hydraulic activated valve to form the fixed part; connecting a second base to an electrically activated valve to form the removable section; configuring the removable section to detachably attach to the fixed part; configuring the hydraulic activated valve of the fixed part to be actuated by the electrically activated valve when the removable section is mated to the fixed part; and providing all functional connections between the fixed part and the removable section such that all functional connections are provided between a flat first surface of the fixed part and a flat second surface of the removable section.

According to yet another exemplary embodiment, there is a method for assembling a control module. The method includes forming a fixed part by connecting a first base to a valve manifold that houses a hydraulic activated valve; forming a removable section by connecting a second base to an electrically activated valve; mating the removable section to the fixed part; configuring the hydraulic activated valve of the fixed part to be actuated through the electrically activated valve of the removable section when the removable section is mated to the fixed part; and providing all functional connections from the fixed part to the removable section between a flat first surface of the fixed part and a flat second surface of the removable section.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a BOP stack. However, the embodiments to be discussed next are not limited to BOP stacks, but may be applied to other elements, e.g., LMRP, that are located in difficult to reach locations.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a subsea structure is operated by providing a first predetermined number of functions. These functions are achieved by actuating hydraulically activated valves (SPM valves). A hydraulically activated valve is controlled by a pilot valve, which may be an electrically activated valve. A fixed part of a control module is configured to include the hydraulically activated valves while a removable section is configured to include the electrically activated valves. The fixed part is fixedly attached to the subsea structure while the removable section is detachably attached to the fixed part. Since the electrically activated valves are more likely to fail in comparison to the hydraulically activated valves, given their service history, the separation of the two types of valves may offer the operator of the subsea structure the possibility to remove with a ROV only the electrically activated valves (the removable section) and not the hydraulically activated valves (the fixed part).

Figure 1:
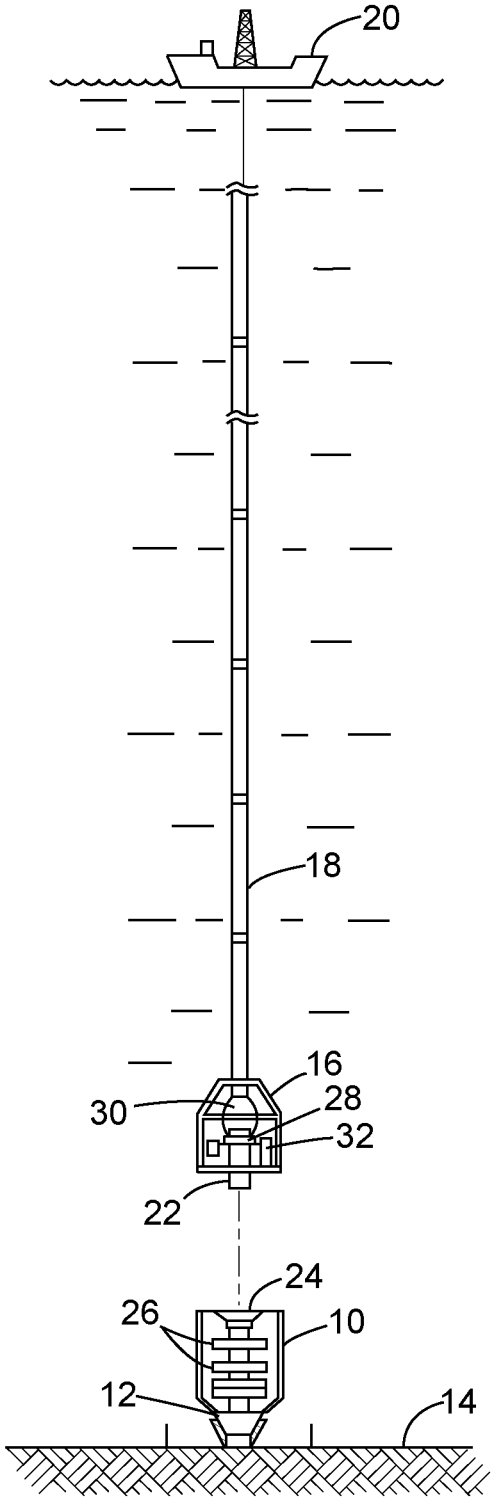
Figure 1 (Background Art)
FIG. 1 is a schematic diagram of a conventional offshore rig.
Figure 2:
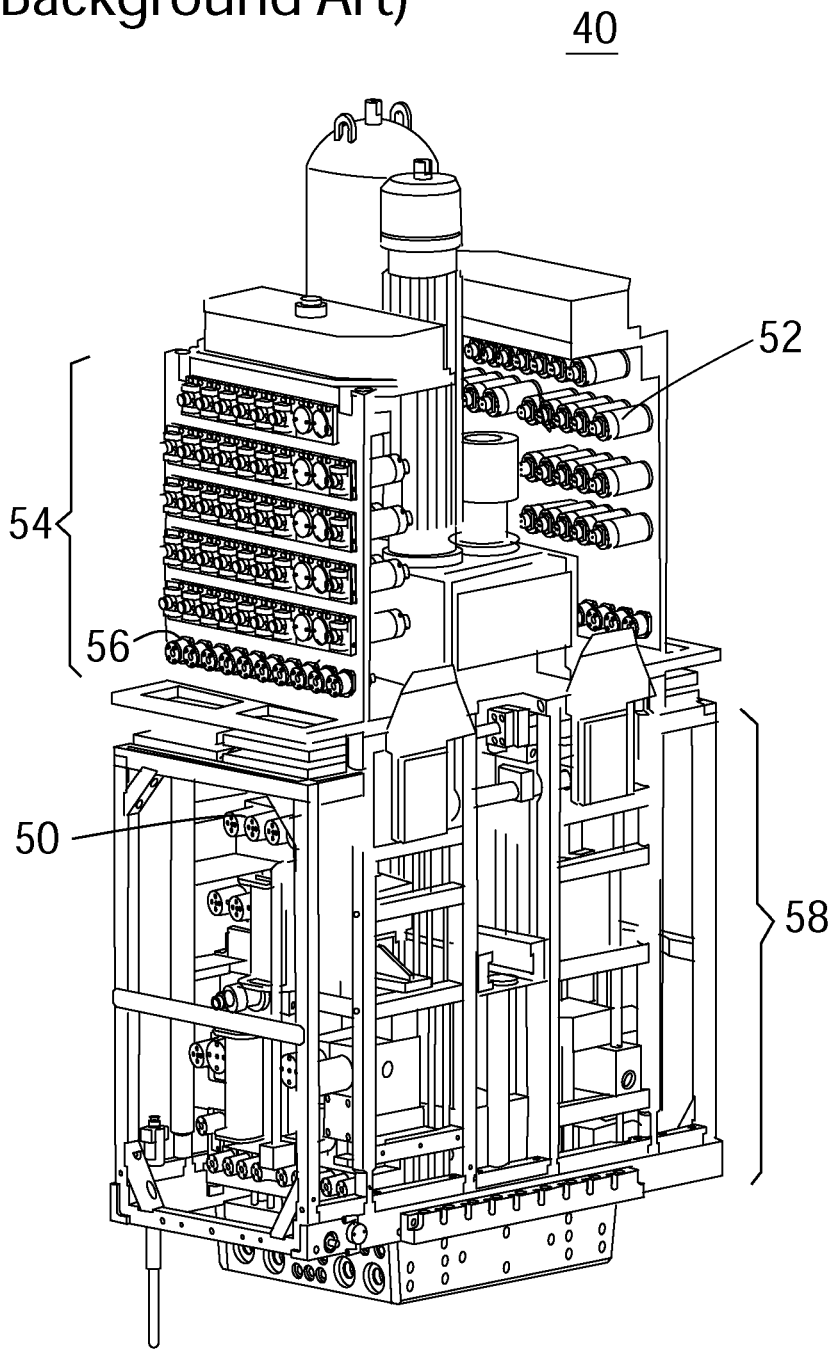
Figure 2 (Background Art)
FIG. 2 is a schematic diagram of a MUX pod.
Figure 3:
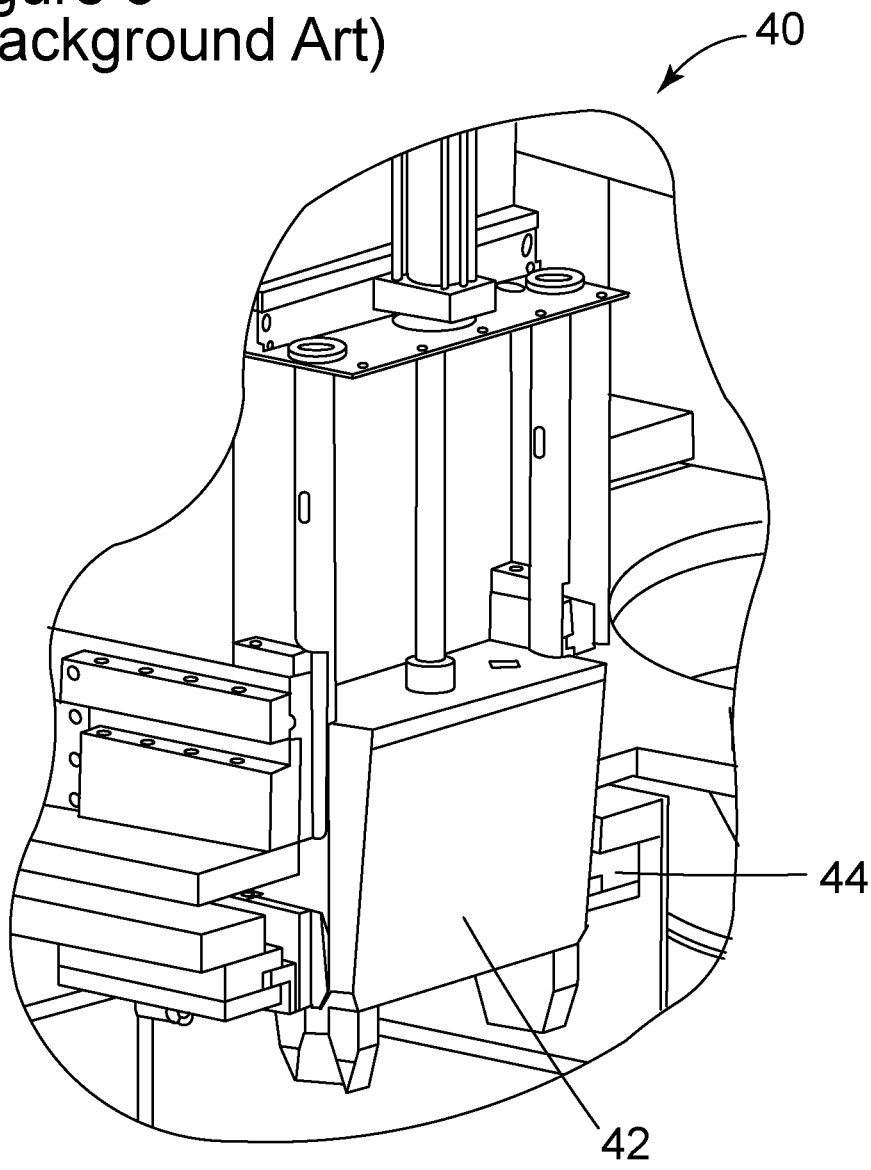
Figure 3 (Background Art)
FIG. 3 is a schematic diagram of a feed-thru connection of a MUX pod attached to a subsea structure.
Figure 4:
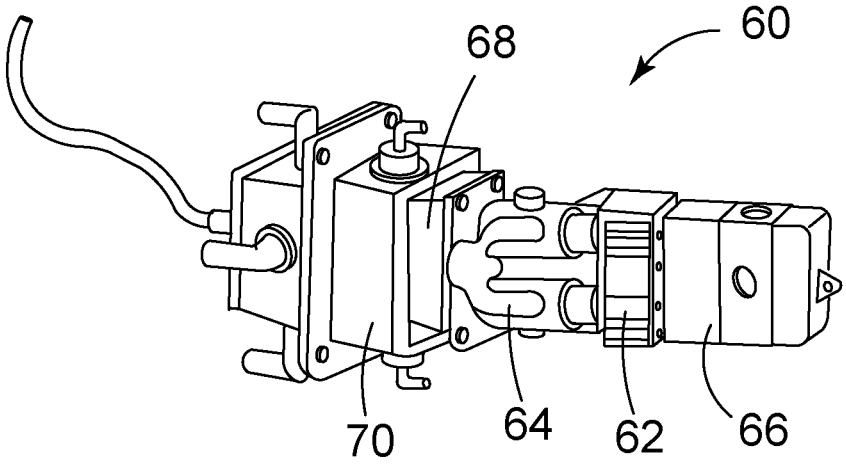
Figure 4 (Background Art)
FIG. 4 is a schematic diagram of a conventional control module that includes both hydraulic and solenoid retrievable valves.

In this way, the size and weight of the part that has to be removed from the subsea structure is smaller, which consequently simplifies the replacement process. In addition, one or more embodiments to be discussed later have the advantage that the control module discussed above is capable of augmenting the number of functions already provided by a dedicated MUX pod. As was discussed previously, a MUX pod may be a standard piece of equipment for an LMRP. The MUX pod has a dedicated number of functions that are customized for each user. After being deployed on the subsea structure, the MUX pod ability to increase the provided number of functions is limited because of the connection between the BOP stack and the LMRP (see FIG. 3). Thus, the above discussed control module is also capable of extending the number of functions to be implemented at the subsea structure.

Figure 5:
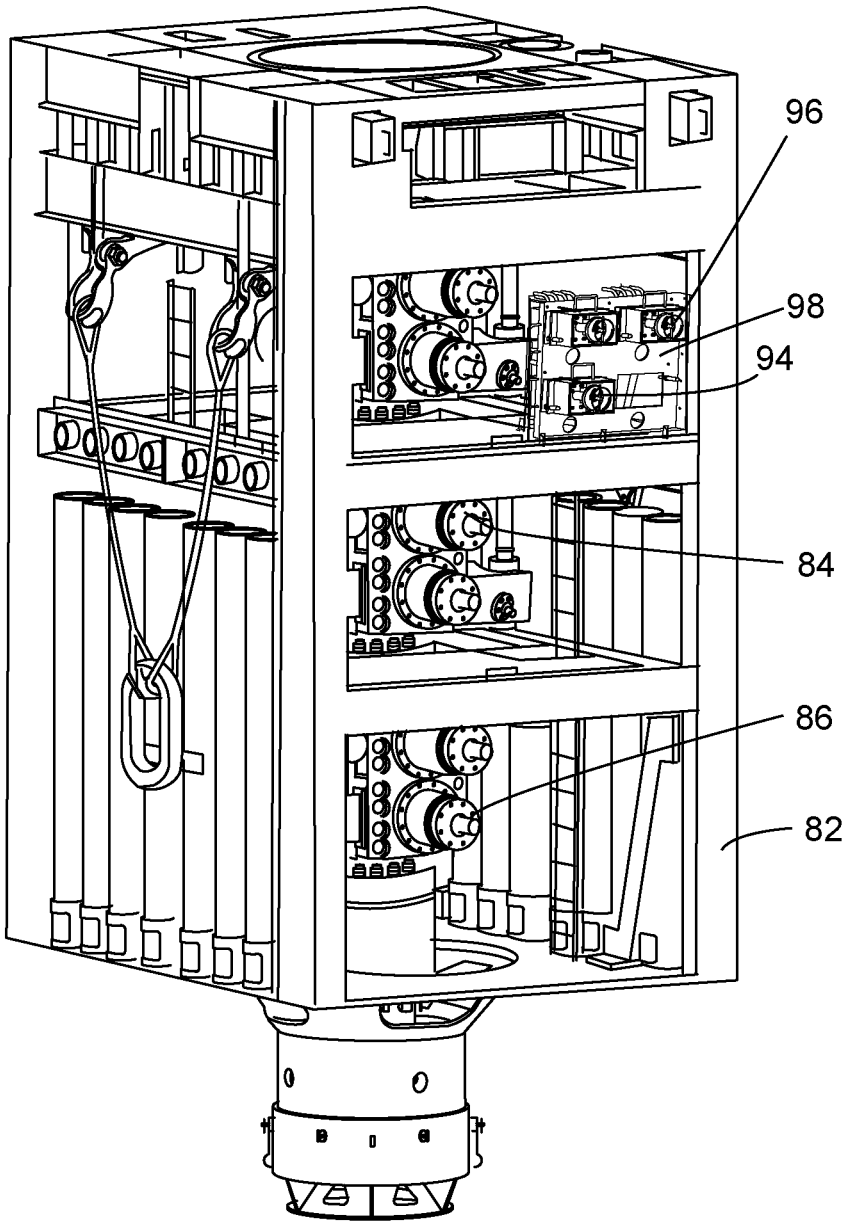
FIG. 5 is a schematic diagram of a BOP stack having a control module according to an exemplary embodiment.
Figure 6:
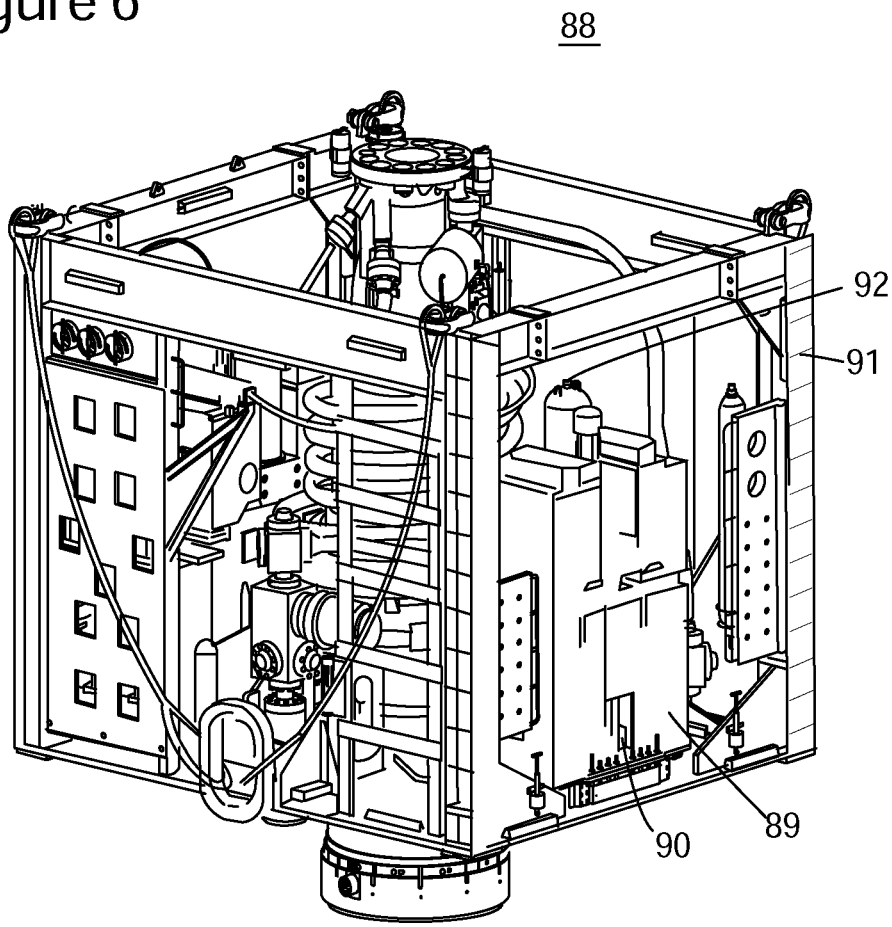
FIG. 6 is a schematic diagram of an LMRP having a MUX pod.

The structure of the control module is discussed now in more details. According to an exemplary embodiment, FIG. 5 shows a BOP stack 80. The BOP stack 80 includes a frame 82 to which one or more BOPs (84 and 86) are attached. Besides the BOPs, a BOP stack may include other elements, e.g., hydraulic accumulators, hydraulic filters, electronic vessels, communication lines, power supply lines, pressure sensors, position sensors, choke and kill valves, shear valves, etc. The LMRP may also include the elements noted above. An LMRP 88 is shown in FIG. 6. Part of the elements located on the BOP stack (and/or LMRP) are actuated based on hydraulic pressure (a fluid under pressure either pumped from the sea level or from accumulators attached to the BOP stack) and/or electrical signals (e.g., a solenoid valve). Thus, any subsea structure may have a hydraulic supply and an electric supply. The LMRP 88 may include a MUX pod 89 that is fixed to a frame 91 of the LMRP 88. For redundancy, the LMRP 88 includes two MUX pods. The MUX pod 89 is configured to receive hydraulic pressure at an inlet 90 and electric power/communication signals at a connection 92. Various functions are controlled by the MUX pod 89, which acts as the brain of the BOP 80 stack and/or LMRP 88.

According to an exemplary embodiment, when new functions need to be added to the BOP stack 80 and the MUX pod 88 has no available port to control the new functions, a new control module 94 (see FIG. 5) may be added to the BOP stack 80. In the following, the BOP stack is used to describe the exemplary embodiments, but it should be understood that the same applies to the LMRP or other structures.

FIG. 5 shows two new control modules 94 and 96 being added to the BOP stack 80. The number of control modules to be added depends on the desired number of functions to be added and also on the number of functions available at the new control module. In one application, the control module 94 has 8 new functions. However, this number can be smaller or larger depending on the needs of the BOP stack operator, the space available, etc. The control modules 94 and 96 may be fixed to their own frame 98 that is attached to the BOP stack's frame 82 as shown in FIG. 5.

Figure 7:
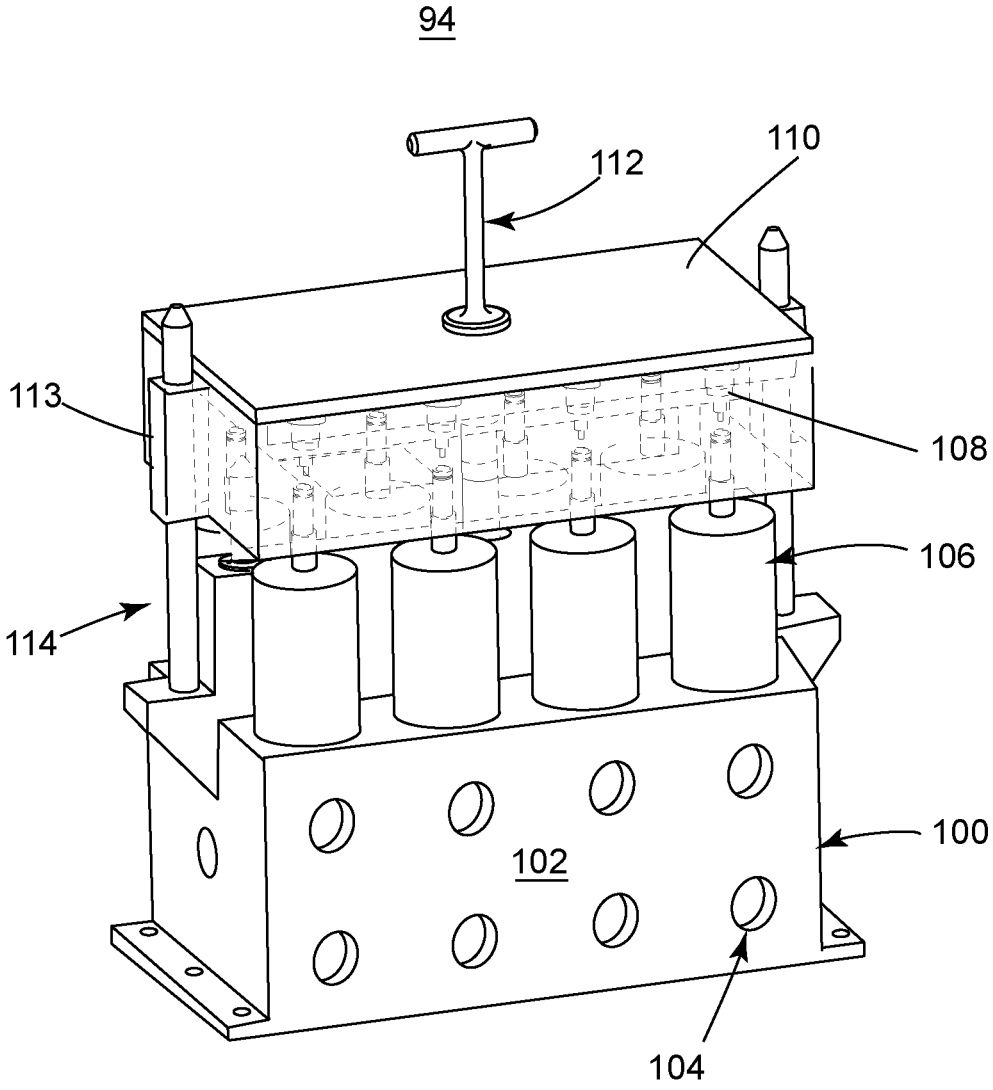
FIG. 7 is a schematic diagram of a control module having a removable section according to an exemplary embodiment.

FIG. 7 shows in more details the control module 94. Control module 94 includes a fixed part 100 that is fixedly attached to the frames 82 or 98. The fixed part 100 may include a valve manifold 102 having plural hydraulic fluid ports 104 that connect to the various functions that are desired to be implemented and controlled. The valve manifold 102 is configured to house a predetermined number of hydraulically activated valves (SPM valves) 106. FIG. 7 shows 8 SPM valves 106 but a different number may be used. The SPM valves 106 are fixedly attached to the valve manifold 102 and they are configured to control a fluid flow to the fluid ports 104.

A SPM valve 106 is hydraulically activated, e.g., it needs a supply of a fluid under pressure to open or close the valve. In other words, the SPM valve controls the flow of a fluid under pressure there through by receiving the supply of a hydraulic fluid under pressure at a gate of the SPM valve. The supply of fluid under pressure is provided by a corresponding pilot valve 108, which is better seen in FIG. 8. The pilot valve 108 may be an electrically activated valve. An electrically activated valve is a valve that controls a fluid flow based on electrical signals. An example of an electrically activated valve is a solenoid valve. The pilot valves 108 are located in a removable section 110 that is configured to be detachably attached to the fixed part 100.

Figure 14:
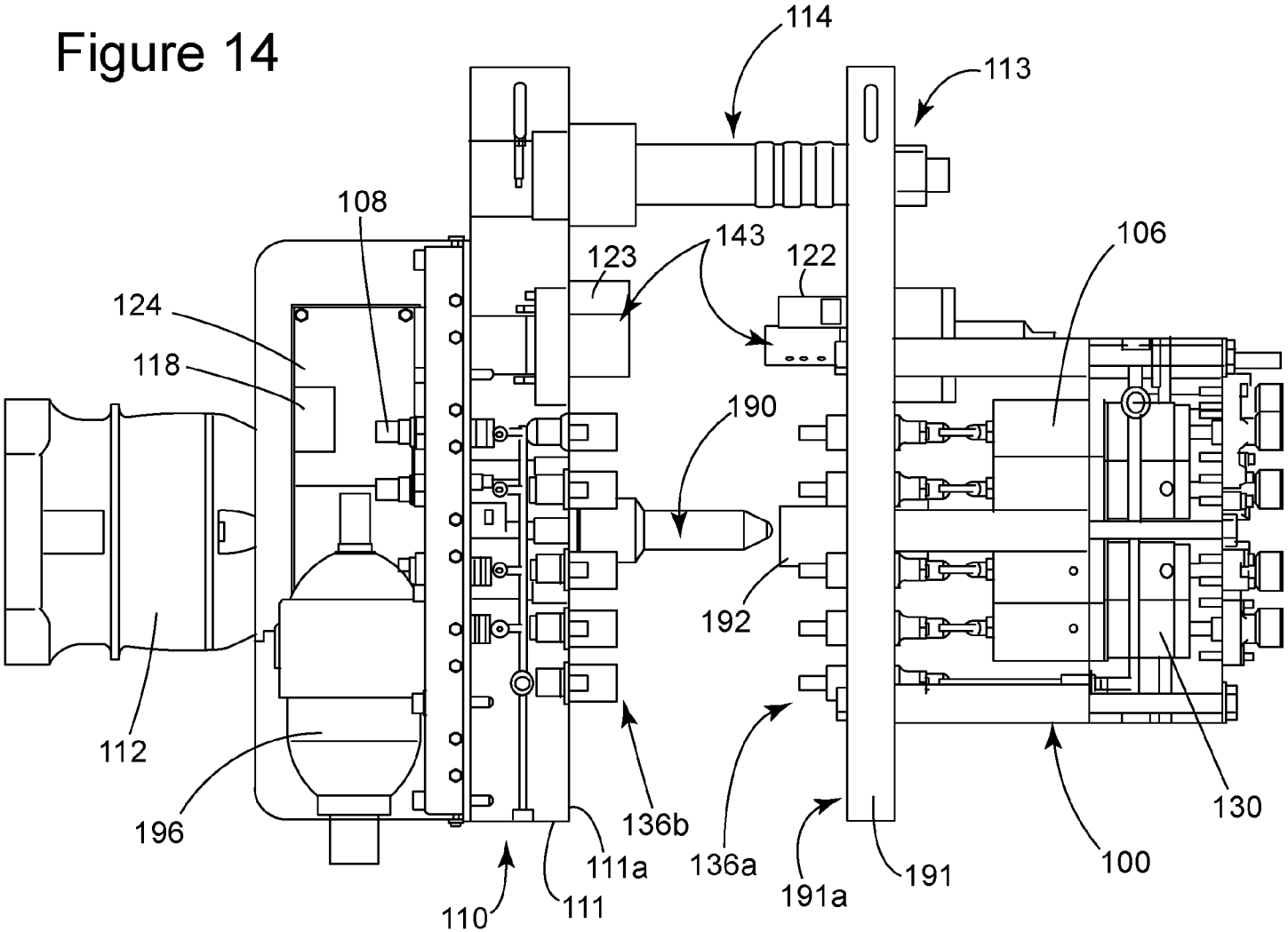
FIG. 14 is a schematic diagram of a control module according to an exemplary embodiment.

In one exemplary embodiment, the removable section 110 may include a connecting device 112 (see FIG. 7) that is configured to be handled by the ROV vehicle when the removable section 110 needs to be removed. The shape and size of the connecting device 112 depends on an existing tool on the ROV vehicle or other considerations of the operator. In one application, the connecting device is a bucket as shown in FIG. 14. Back to FIG. 7, the removable section 110 may include guides 113 that mate with corresponding guides 114 on the fixed part 100. The guides may be used by the ROV vehicle when mating the removable section 110 to the fixed part 100.

Figure 8:
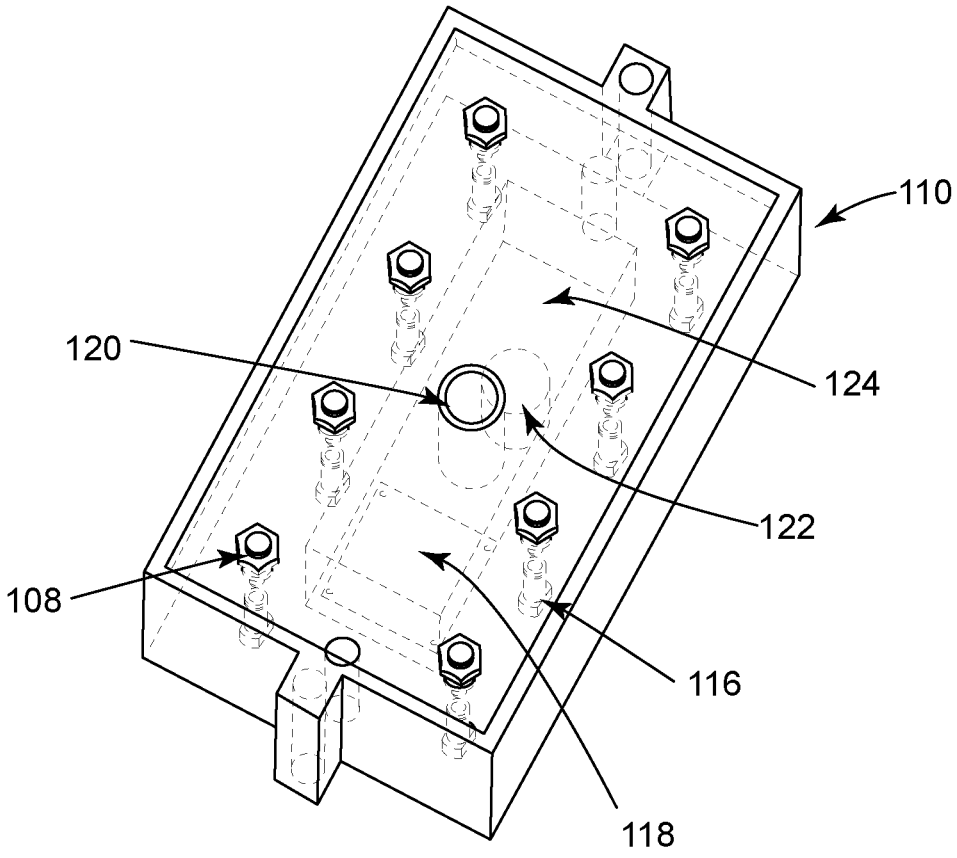
FIG. 8 is a schematic diagram of a removable section of a control module according to an exemplary embodiment.

The removable section 110 may also include a fitting 116 (as shown in FIG. 8) that connects the pilot valve 108 to the SPM valve 106, a power and communication board 118 that is configured to receive the electric communications and/or a power supply and a communication connection 122, e.g., a wet-mate electrical connector that is configured to communicate to the MUX pod 60 and to distribute the power and/or signals to corresponding pilot valves 108 and pressure sensing devices (not shown). FIG. 8 also shows a ROV handle port 120 corresponding to the connecting device 112 and the wet-mate electrical connector 122 that is configured to connect to a corresponding wet-mate connector on the fixed part for receiving the electrical signals and/or power supply from the MUX pod 60. A cavity 124 may be present inside the removable section 110 that accommodates the power and communication board 118. The cavity 124 may be maintained at a pressure around atmospheric pressure so as to protect the electrical components when the high pressures undersea are exerted on the removable section. Alternately, cavity 124 may be filled with a non-conducting fluid maintained at ambient subsea pressure (using, for example, a compensator) at a given subsea depth at which the control module is installed.

In this way, the pilot valves 108 and the associated electronics may be separated from the SPM valves 106 and thus, in case of failure of a pilot valve or an electronic component, only these elements are retrieved and not the SPM valves. For this reason, the weight and size of the removed part is considerable less than the weight and size of the entire unit, which makes the replacement more feasible.

Figure 9:
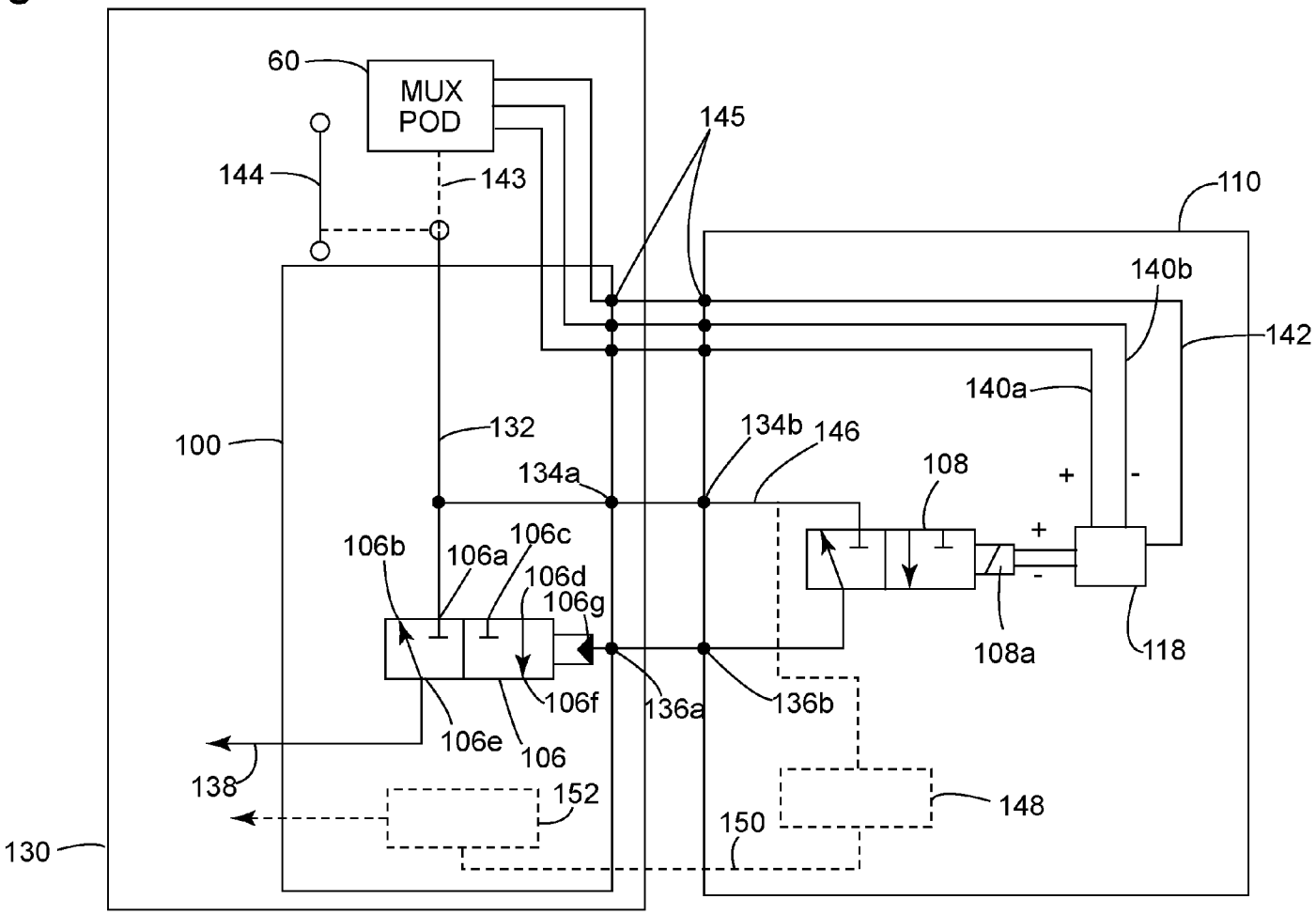
FIG. 9 is a schematic diagram of a control module according to an exemplary embodiment.

According to an exemplary embodiment, a schematic diagram of the fixed part 100 and the removable section 110 is shown in FIG. 9. FIG. 9 shows an implementation of the fixed part 100 and the removable section 110 on the LMRP 130. That means that the MUX pod 60 and the fixed part 100 are fixed to the LMRP 130. The removable section 110 is removably attached to the fixed part 100. The fixed part 100 includes one or more SPM valves 106 (only one is shown for simplicity). The high pressure fluid is received via conduit 132 to a first input 106*a* of the SPM valve 106. In this exemplary embodiment, SPM valve 106 has inputs and outputs 106*a* to 106*f*. SPM valves 106 with other configurations may be used.

SPM valve 106 is activated by receiving the fluid under high pressure at gate 106*g*. This fluid is controlled by pilot valve 108 provided in the removable section 110. Pilot valve 108 may have a similar structure as the SPM valve 106 except that an electrical gate 108*a* is used to activate the valve. The pilot valve 108 may receive the fluid under pressure from the same conduit 132 used by the SPM valve 106 or another hydraulic source. Thus, connections 134*a* and 134*b* are implemented on the fixed part 100 and the removable section 110, respectively, for bringing the fluid under pressure to the pilot valve 108. Similar or different connections 136*a* and 136*b* are used for providing the fluid under pressure from the pilot valve 108 to the SPM valve 106 when a corresponding electrical signal is received at gate 108*a*. Thus, when the pilot valve 108 is activated, the fluid from conduit 132 flows via the pilot valve 108 to the gate 106*g* to activate the SPM valve 106. After the SPM valve gate 106*g* is activated, fluid from conduit 132 flows via SPM valve 106 to outlet 138 and to the desired function to be controlled.

It is noted in this exemplary embodiment that the fluid under pressure entering conduit 132 may be provided either directly from MUX pod 60 along a conduit or from another source, e.g., hot line 144. The fluid may be regulated internally at the MUX pod 60. The hot line 144 may be connected to accumulators or to a conduit that communicates with the ship (not shown) manning the operation of the LMRP.

Similar to the fixed part 100, the removable section 110 may include more than one pilot valve 108. The removable section 110 also includes an electronic part 118 that is electrically connected to the pilot valves for transmitting various commands to them. The electronic part 118 may be connected to power supply lines 140*a* and 140*b* that are connected to the MUX pod 60 via the fixed part 100. In addition, the electronic part 118 may include one or more lines 142 (e.g., RS 485 cables) for transmitting various commands from the MUX pod 60 to the corresponding solenoid valves 108 via the fixed part 100. Corresponding wet-mateable electric connectors 145 (e.g., connectors configured to mate/de-mate subsea) may be mounted on the fixed part 100 and the removable section 110 for transmitting the electric power and the commands from one module to the other. Multiple fixed parts 100 and corresponding removable sections 110 may be used on the same subsea structure.

If more than one pilot valve 108 is provided on the removable section 110, the same supply line 146 may be used to supply the fluid under pressure to each of the pilot valve 108. However, each pilot valve 148 would have its own output 150 fluidly communicating with a corresponding SPM valve 152. In other words, for a control module (fixed part 100 and removable section 110) having 8 functions, there are 8+1 inlet hydraulic ports, one corresponding to conduit 146 and the others corresponding to outlet ports 150. In one application, the conduit 146 may be connected to another source of fluid under pressure instead of the MUX pod 60 or conduit 144. The removable section 110 may include other elements than those shown in the figures. For example, the removable section 110 may include one or more filtration devices, pressure sensing devices, etc. Similarly, the fixed part may include other devices, e.g., pressure regulators.

If the fixed part 100 and the removable section 110 are disposed on the BOP stack, then the power supply and the communication supply may stay the same, e.g., from MUX pod 60, but the hydraulic supply may provided by a hot line that provides the fluid under high pressure for operating the BOPs of the BOP stack.

Figure 10:
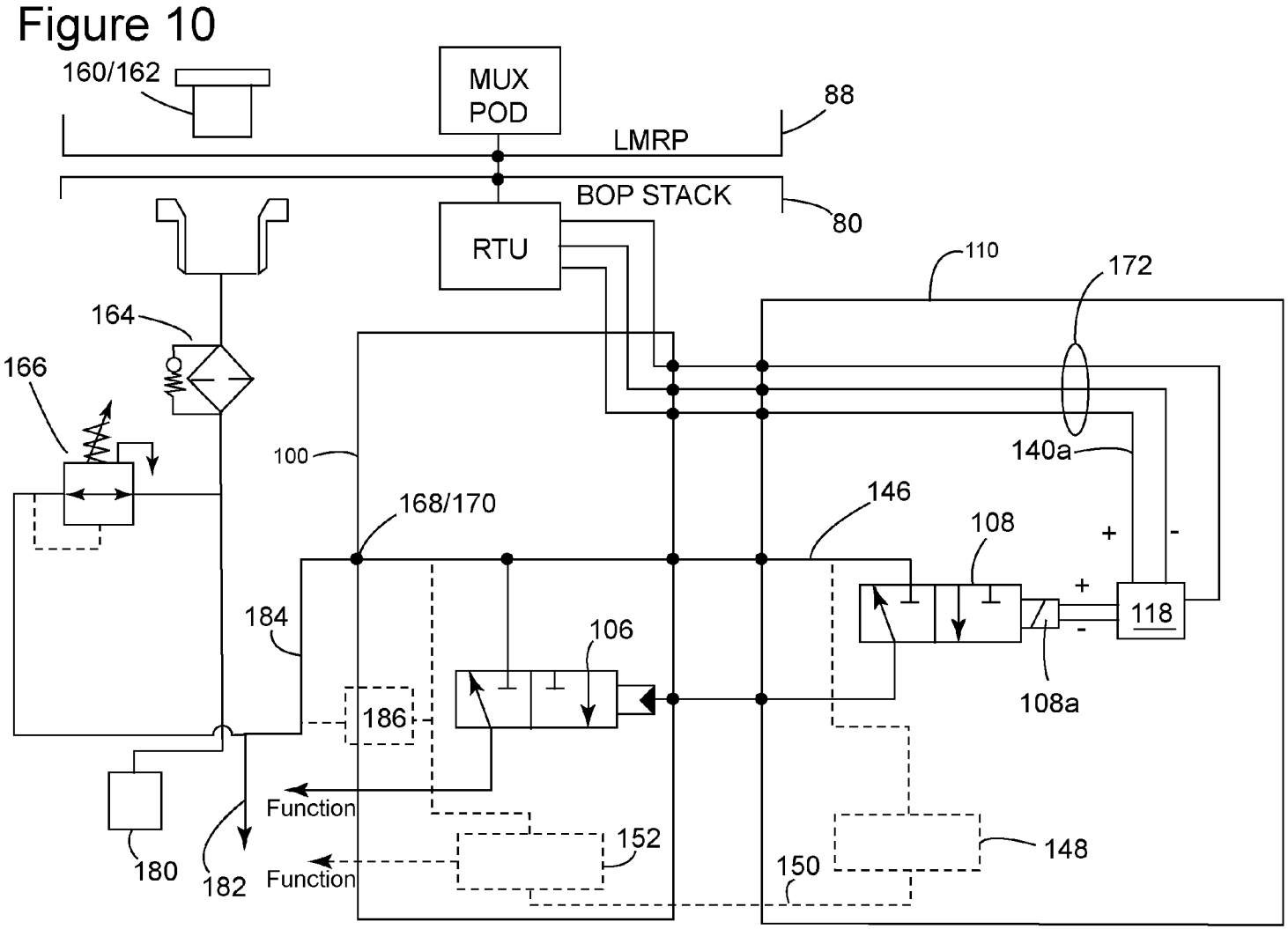
FIG. 10 is a schematic diagram of a control module provided on a BOP stack according to an exemplary embodiment.

According to an exemplary embodiment, FIG. 10 illustrates a possible hydraulic and electrical arrangement for the fixed part 100 and the removable section 110 when the control module is provided on the BOP stack. A 5,000 psi yellow line 160 and a 5,000 psi blue line 162 (these are existing lines for supplying the fluid under high pressure to BOPs but other lines may also be used) are provided from the LMRP part to the BOP stack. The received fluid may be filtered in a filtration unit 164 prior to being provided as the hydraulic supply for the removable section 110. Various pressure regulators 166 (devices for changing the pressure of the fluid from, for example, 5,000 psi to 3,000 psi or another desired value) may be used either to change the pressure of the fluid. Both lines are provided to the fixed part 100 at inlets 168 and 170. From here, the pilot hydraulic pressure at inlet 170 is provided via conduit 146 to the removable section 110 while the hydraulic pressure at inlet 168 is provided to SPM valves 106. By appropriately controlling the pilot valves 108, via commands received at the electronic part 118 along a power and communication line 172, corresponding SPM valves 106 are opened or closed as required to provide the desired functions.

The pressure values illustrated in FIG. 10 are for exemplary purposes and not intended to limit the applicability of the novel features. Other pressure values may be used depending on the BOP stack and other factors. The LMRP 88 is shown detached from the BOP stack 80. However, after the fluid connection is achieved between the two parts, the yellow and blue lines are active and fluid under high pressure is available to the BOP stack from the LMRP. A stack of accumulators 180 may be present on the BOP stack and connected to the blue and/or yellow lines to be recharged. Pressure regulator 166 reduces the pressure to 4,000 psi for the shearing function at conduit 182 while the same fluid is provided along conduit 184 either to the fixed part 100 or via another pressure regulator 186 to the fixed part 100.

Figure 11:
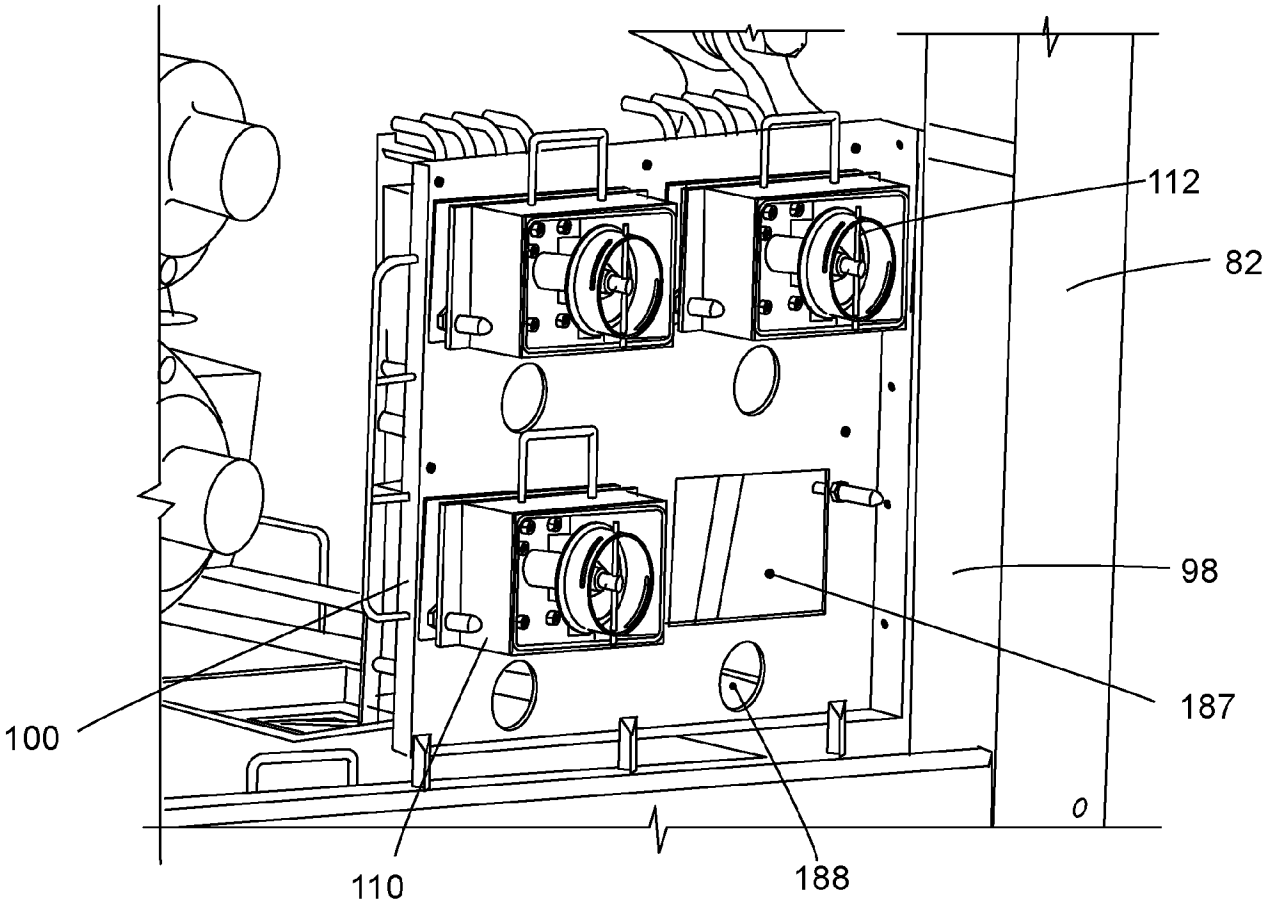
FIG. 11 is an overall view of a control module according to an exemplary embodiment.

According to an exemplary embodiment illustrated in FIG. 11, the fixed part 100 and the removable section 110 may be connected to a frame 98 that has multiple slots for accommodating these elements. FIG. 11 shows an empty slot 187 for receiving another control module 94. Frame 98 also may include a docking receptacle 188 (e.g., a hole in the frame, a stab or other elements) for helping the ROV device to dock in order to access the removable section 110.

Figure 12:
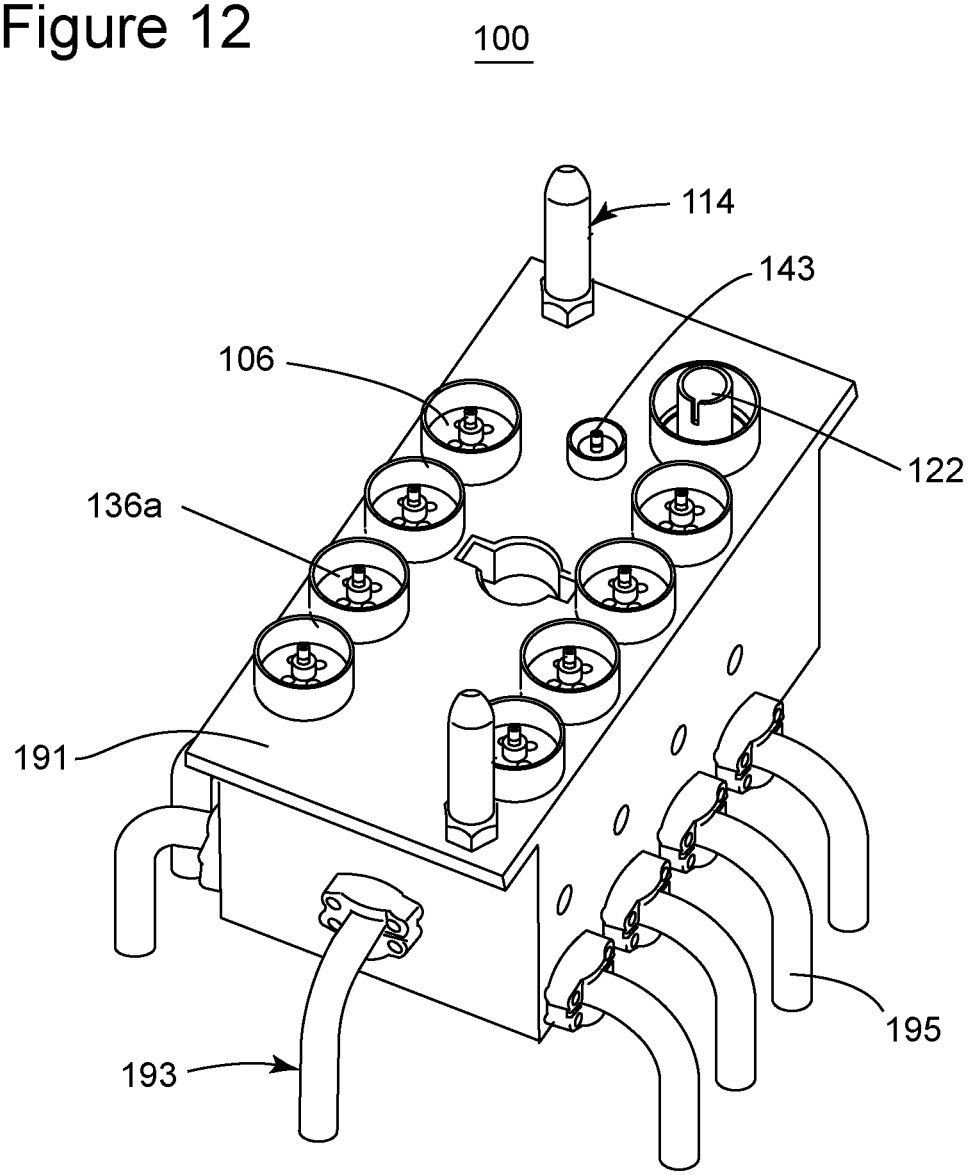
FIG. 12 is an overall view of a fixed part of a control module according to an exemplary embodiment.

FIG. 12 shows in more details the fixed part 100 associated with the embodiment illustrated in FIG. 11. The fixed part includes guiding elements 114 that are configured to mate with corresponding elements on the removable section 110. The wet-mate connector 122 is provided on the fixed part 100 for providing power supply and/or communication signals to the removable section 110. A hydraulic fluid under pressure is provided to the removable section 110 through an outlet 143. The SPM valves 106 are attached to a base 191 of the fixed part 100. Hydraulic stabs 136*a* are connected to the SPM valves 106 and are configured to connect to the pilot valves of the removable section. A hydraulic supply 193 provides the fluid under pressure to the fixed part 100 and part of this supply is provided to the desired functions along ports 195 when corresponding SPM valves 106 are actuated.

Figure 13:
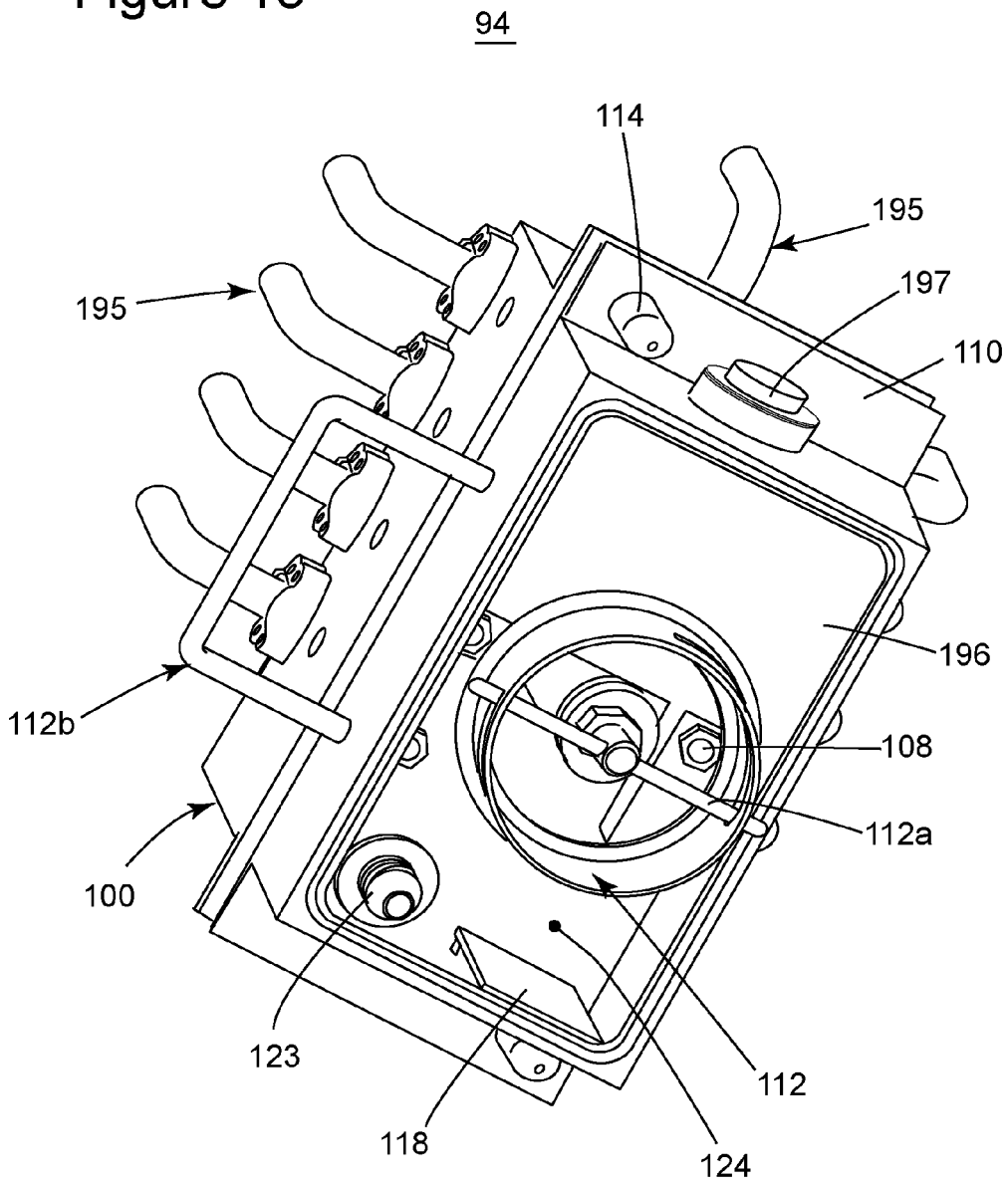
FIG. 13 is an overall view of a removable section of a control module according to an exemplary embodiment.

FIG. 13 shows an overall view of the control module 94 in which the removable section 110 is coupled to the fixed part 100. FIG. 13 shows the connecting element 112 including a low torque handle 112*a*. By rotating the handle 112*a* in one direction the removable section 110 is locked to the fixed part 100 and by rotating the handle 112*a* in the opposite direction the two components are unlocked. Another handle 112*b* may be provided for transporting the removable section. However, handle 112 is optional and a same handle may be used to lock/unlock and transport the removable section. FIG. 13 also shows a wet-mate electrical connector 123 configured to connect to wet-mate connector 122 on the fixed part 100. The cavity 124 of the removable section 110 accommodates the electronics 118. Pilot valves 108 are also visible in this figure. A compensator 196 (to be discussed later) is provided in communication with a port 197 that fluidly communicates with the ambient.

According to an exemplary embodiment illustrated in FIG. 14, the removable section 110 has a bucket as the connecting element 112. Bucket 112 is configured to mate with a ROV vehicle for removing or attaching the removable section 110 to the fixed part 100. The removable section 110 may include a locking device 190 for locking the removable section 110 to the fixed part 100. The fixed part may have a receiving part 192 for receiving the locking device 190. In one application, the locking device 190 includes a screw.

A compensator 196 may be added to the removable section 110 for negating a differential pressure between an ambient subsea pressure (e.g., pressure generated at the ocean floor by the water above) and a pressure inside cavity 124 (when the cavity 124 is filled with a non-conducting fluid, e.g., a dielectric fluid). In this way, the removable section 110 may be located on the ocean floor without endangering the integrity of the electronic components provided inside cavity 124, e.g., power and communication part 118. In this respect, it is noted that some of the electronic components may trap inside air at atmospheric pressure and exposing these components to the high pressure undersea might cause damage.

FIG. 14 also shows details about the fixed part 100 and the removable section 110 and those details are discussed next. The fixed part 100 has a base 191. Base 191 may be a flat metal sheet having an appropriate thickness to prevent a bending of the base. Base 191 may have a flat face 191 on which all parts to be connected to corresponding parts on the removable section 110 are provided. For example, FIG. 14 shows that all connection parts 136*a* that connect to SPM valves 106 are disposed on the flat face 191*a*. In addition, outlet 143 that provides the fluid under pressure to the removable section 110 is also provided on the flat face 191*a* and electrical connector 122 are provided on flat surface 191*a*. In one application, all the functionalities shared by the removable section 110 and the fixed part 100 are provided on the flat face 191*a*, e.g., corresponding part 192 of the locking device 190, and guide 113.

According to an exemplary embodiment, the same is true for the removable section 110. More specifically, all connections parts 136*b*, locking device 190, guide 114, and electrical connector 123 may be provided on a base 111. In one application, these elements may be provided on a single flat surface 111*a* of the base 111. The electronic section 118 may be placed in the cavity 124 and the electronic section is configured to receive electrical signals through electrical connector 123 and transmit electrical signals to appropriate pilot valves 108.

FIG. 14 also shows that a valve manifold 130 is provided behind the base 191 for housing all the hydraulic activated valves 106. Similarly, the pilot valves 108 are housed behind the base 111. According to this exemplary embodiment, all the connections between the removable section 110 and the fixed part 100 are disposed between flat faces 111*a* and 191*a*. In one application, bucket 12 may be provided opposite to the base 111. Those skilled in the art would recognize that the bucket 112 is one possible interface between the ROV and the removable section 110 and other devices may be used to achieve this functionality.

Figure 15:
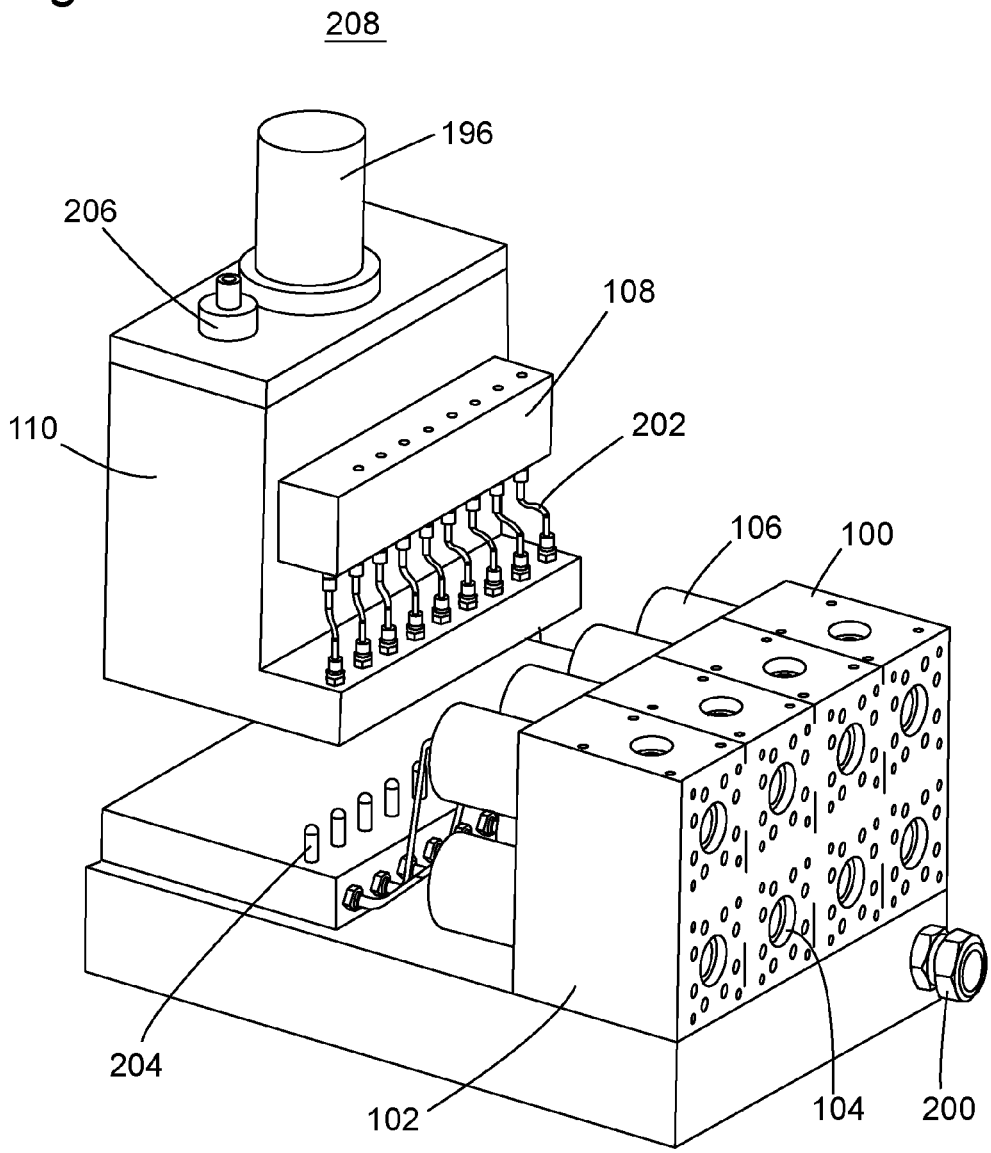
FIG. 15 is a schematic diagram of a control module having a detachable part according to an exemplary embodiment.

While the above discussed exemplary embodiments had the removable section 110 configured to have a mechanism such that the ROV can connect to the mechanism and remove the removable section, FIG. 15 illustrates an exemplary embodiment in which the removable section 110 does not have such a mechanism. In other words, according to this embodiment, the removable section 110 is still removable from the fixed part 100 but not by an ROV vehicle. FIG. 15 shows a hydraulic supply 200 providing the fluid under pressure to the fixed part 100. The fluid under pressure is provided from the fixed part 100 to the removable section 110 when the two parts are mated. The pilot valves 108 are shown grouped together on the removable section 110 while the SPM valves 106 are shown grouped together on the fixed part 100. Conduits 202 are shown connecting the pilot valves 108 to corresponding stubs 204 that fluidly communicate with the SPM valves 106. The pressure compensator 196 is shown mounted on the removable section 110.

This exemplary embodiment differs from other embodiments discussed above in that an electrical bulkhead connector 206 is provided on the removable section 110 to be connected to, for example, the MUX pod (not shown in this figure) without passing through the fixed part 100. An advantage of this exemplary removable section 110 is as discussed next. Assuming that at least a pilot valve 108 is faulty, the entire control module 208 needs to be brought to the surface for maintenance. The control module 208 may have a weight of approximately 800 kg while the removable section 110 may have a weight of approximately 200 kg. However, because only the removable section 110 needs to be handled as the pilot valve 108 is provided in the removable section 110, a crane for removing the removable section 110 may be smaller and/or the effort and human involvement in manipulating the removable section 110 may be reduced.

Figure 16:
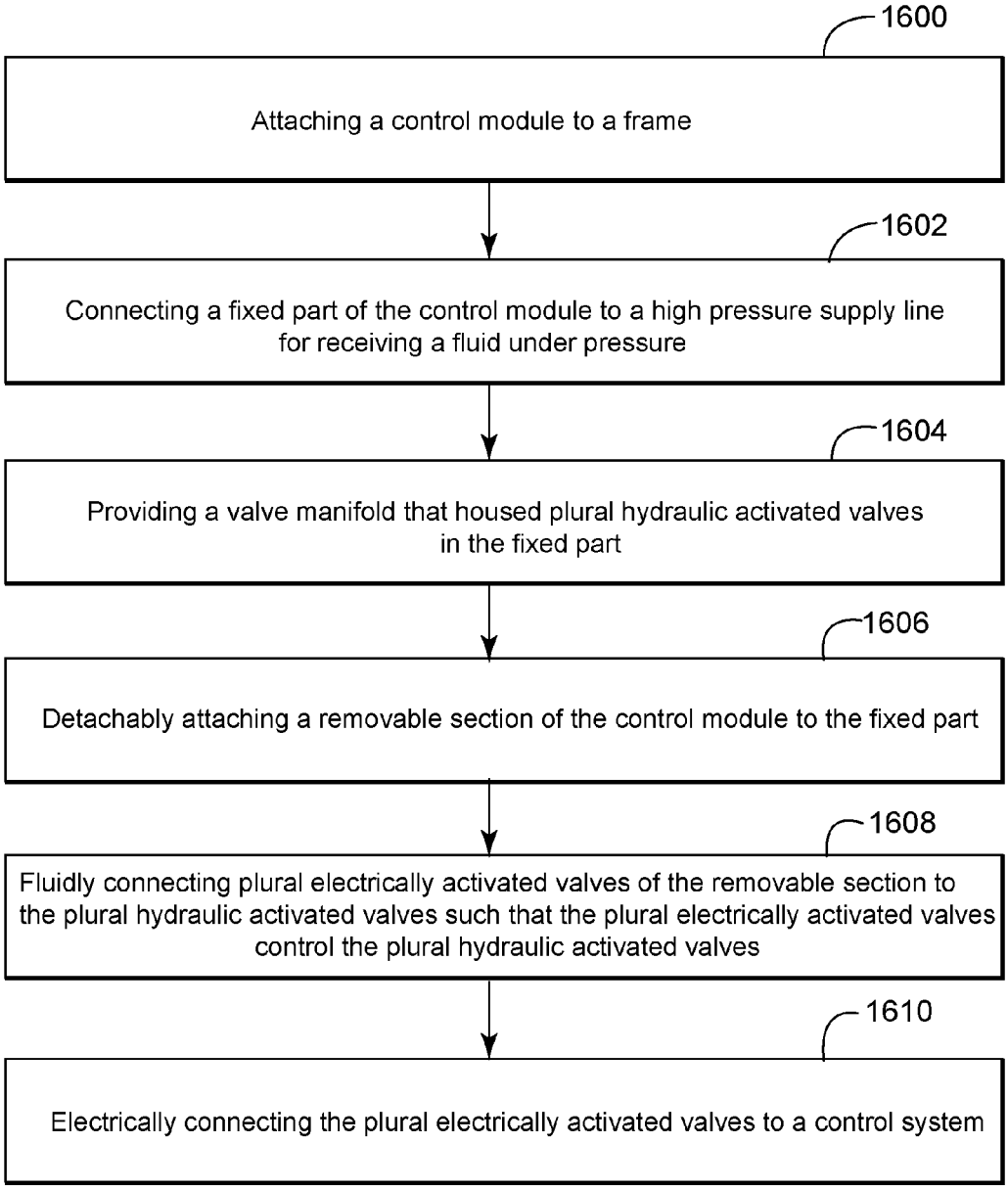
FIG. 16 is a flow chart illustrating a method for assembling a control module according to an exemplary embodiment.

According to an exemplary embodiment, illustrated in FIG. 16, there is a method for assembling a control module. The method includes a step 1600 of attaching a control module to a frame, a step 1602 of connecting a fixed part of the control module to a high pressure supply line for receiving a fluid under high pressure, a step 1604 of providing a valve manifold that houses plural hydraulic activated valves in the fixed part, a step 1606 of detachably attaching a removable section of the control module to the fixed part, a step 1608 of fluidly connecting plural electrically activated valves of the removable section to the plural hydraulic activated valves such that the plural electrically activated valves control the plural hydraulic activated valves, and a step 1610 of electrically connecting the plural electrically activated valves to a control system.

Figure 17:
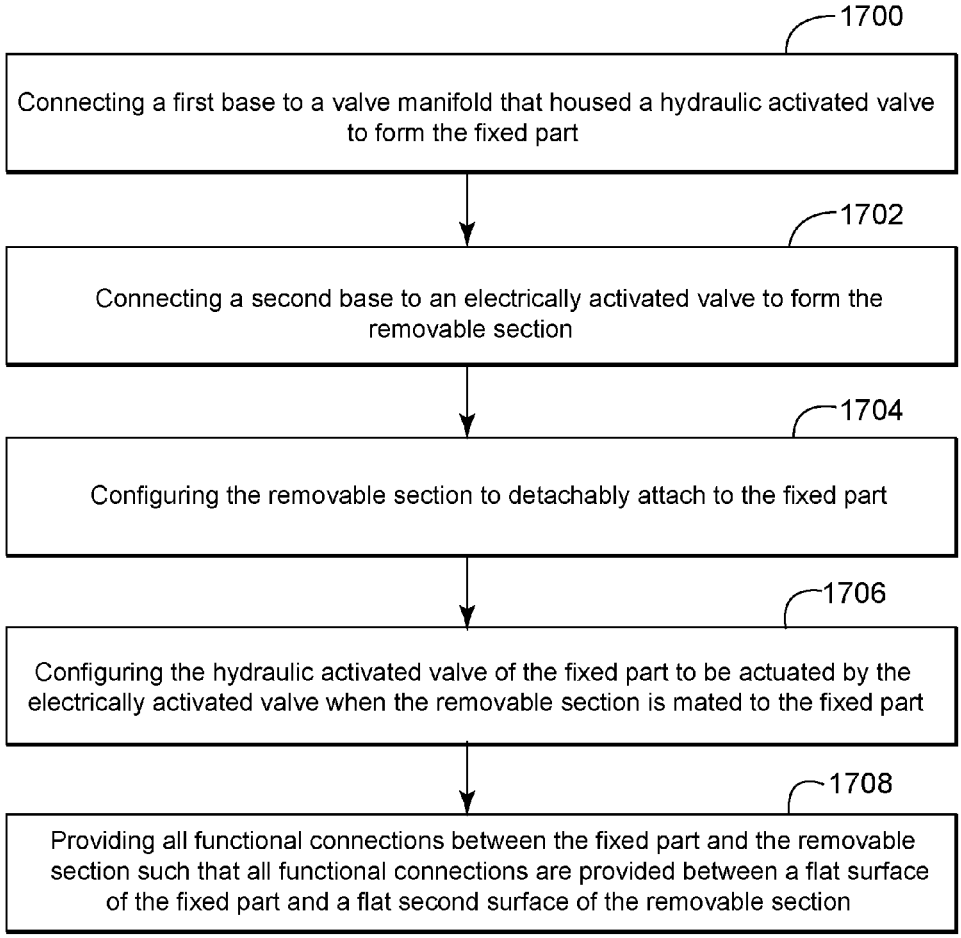
FIG. 17 is a flow chart illustrating another method for assembling a control module according to an exemplary embodiment.

According to an exemplary embodiment, illustrated in FIG. 17, there is another method for assembling a control module. The method includes a step 1700 of connecting a first base to a valve manifold that houses a hydraulic activated valve to form the fixed part, a step 1702 of connecting a second base to an electrically activated valve to form the removable section, a step 1704 of configuring the removable section to detachably attach to the fixed part, a step 1706 of configuring the hydraulic activated valve of the fixed part to be actuated by the electrically activated valve when the removable section is mated to the fixed part, and a step 1708 of providing all functional connections between the fixed part and the removable section such that all functional connections are provided between a flat first surface of the fixed part and a flat second surface of the removable section.

Figure 18:
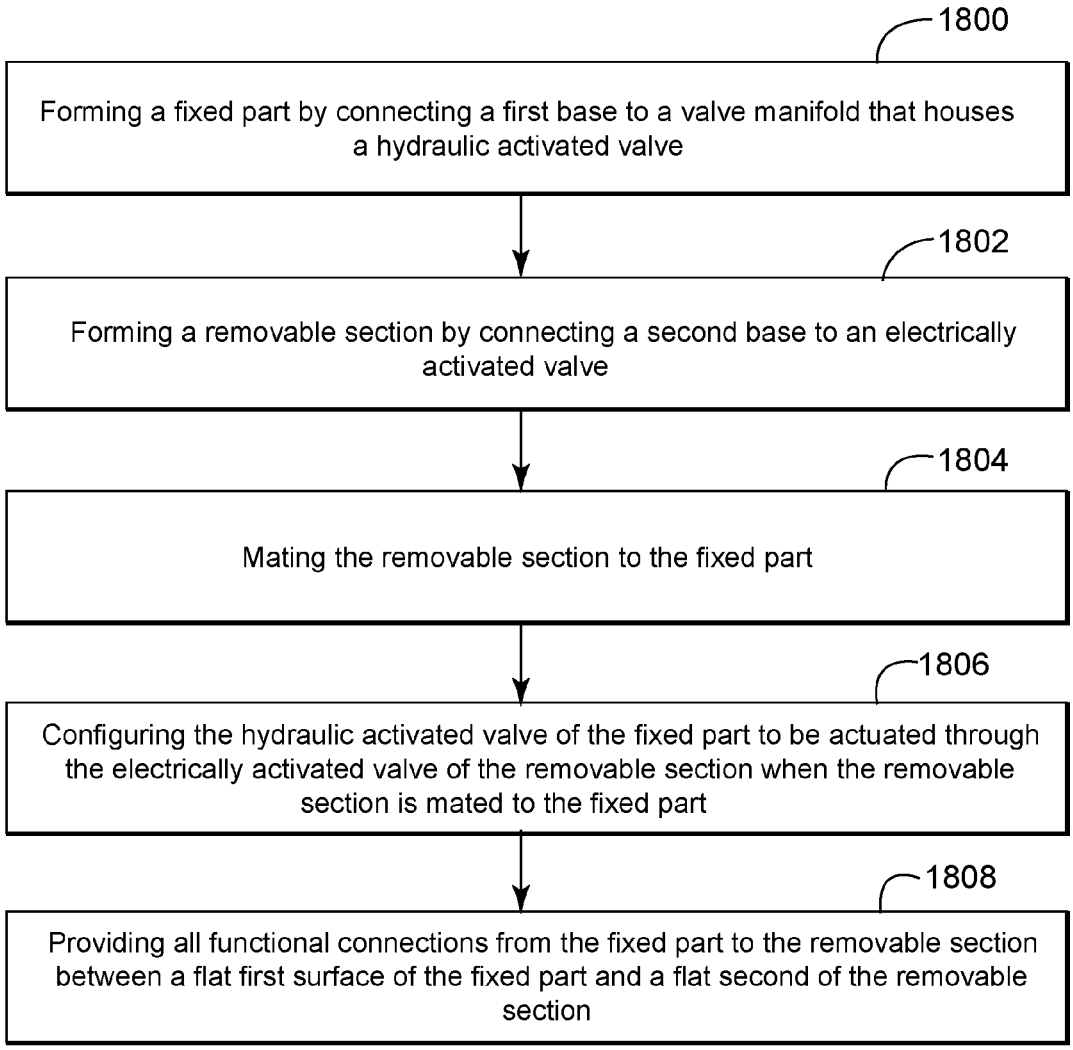
FIG. 18 is a flow chart illustrating still another method for assembling a control module according to an exemplary embodiment.

According to an exemplary embodiment, illustrated in FIG. 18, there is still another method for assembling a control module. The method includes a step 1800 of forming a fixed part by connecting a first base to a valve manifold that houses a hydraulic activated valve, a step 1802 of forming a removable section by connecting a second base to an electrically activated valve, a step 1804 of mating the removable section to the fixed part, a step 1806 of configuring the hydraulic activated valve of the fixed part to be actuated through the electrically activated valve of the removable section when the removable section is mated to the fixed part, and a step 1808 of providing all functional connections from the fixed part to the removable section between a flat first surface of the fixed part and a flat second surface of the removable section.

The disclosed exemplary embodiments provide a system and a method for assembling a control module. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method for assembling a control module having a fixed part and a removable section, the method comprising:

configuring the fixed part of the control module to be attached to a pressure supply line for receiving a fluid under pressure;

providing in the fixed part a valve manifold that houses a hydraulic activated valve;

detachably attaching the removable section of the control module to the fixed part;

fluidly connecting an electrically activated valve of the removable section to the hydraulic activated valve such that the electrically activated valve controls the hydraulic activated valve;

configuring the electrically activated valve to electrically connect to a control section; and attaching to the fixed part an electronic section that is configured to control the electrically activated valve.

2. The method of claim 1, further comprising: adding only hydraulically activated valves to the fixed part.

3. The method of claim 1, further comprising: adding only electrically activated valves to the removable section.

4. The method of claim 1, further comprising: attaching to the removable section a connection device configured to be connected to a remotely operated vehicle for being removed from the fixed part.

5. A method for assembling a control module having a fixed part and a removable section, the method comprising:

configuring the fixed part of the control module to be attached to a pressure supply line for receiving a fluid under pressure;

providing in the fixed part a valve manifold that houses a hydraulic activated valve;

detachably attaching the removable section of the control module to the fixed part;

fluidly connecting an electrically activated valve of the removable section to the hydraulic activated valve such that the electrically activated valve controls the hydraulic activated valve;

configuring the electrically activated valve to electrically connect to a control section; and providing on the removable section a wet-mate electrical connector configured to be connected to a corresponding wet-mate electrical connector on the fixed part for receiving electrical signals to actuate the electrically actuated valve.

6. A method for assembling a control module having a fixed part and a removable section, the method comprising:

configuring the fixed part of the control module to be attached to a pressure supply line for receiving a fluid under pressure;

providing in the fixed part a valve manifold that houses a hydraulic activated valve;

detachably attaching the removable section of the control module to the fixed part;

fluidly connecting an electrically activated valve of the removable section to the hydraulic activated valve such that the electrically activated valve controls the hydraulic activated valve;

configuring the electrically activated valve to electrically connect to a control section; and configuring the fixed part to receive electrical signals from a multiplexer pod.

7. A method for assembling a control module having a fixed part and a removable section, the method comprising:

configuring the fixed part of the control module to be attached to a pressure supply line for receiving a fluid under pressure;

providing in the fixed part a valve manifold that houses a hydraulic activated valve;

detachably attaching the removable section of the control module to the fixed part;

fluidly connecting an electrically activated valve of the removable section to the hydraulic activated valve such that the electrically activated valve controls the hydraulic activated valve;

configuring the electrically activated valve to electrically connect to a control section; and configuring the pressure supply line to fluidly attach to a multiplexer pod.

8. A method for assembling a control module having a fixed part and a removable section, the method comprising:

connecting a first base to a valve manifold that houses a hydraulic activated valve to form the fixed part;

connecting a second base to an electrically activated valve to form the removable section;

configuring the removable section to detachably attach to the fixed part;

configuring the hydraulic activated valve of the fixed part to be actuated by the electrically activated valve when the removable section is mated to the fixed part;

providing all functional connections between the fixed part and the removable section such that all functional connections are provided between a flat first surface of the fixed part and a flat second surface of the removable section;

wherein the functional connections include all hydraulic connections between hydraulic activated valves of the fixed part and electrically activated valves of the removable section; and wherein the functional connections further include a locking device configured to secure the removable section to the fixed part, guides configured to facilitate a mating between the fixed part and the removable section, and electrical connectors configured to electrically connect the fixed part to the removable section.

9. The method of claim 8, further comprising: providing eight electrically activated valves on the removable section and each electrically activated valve includes at least a solenoid.

10. The method of claim 8, further comprising: attaching to the removable section an electronic section configured to control the electrically activated valve.

11. The method of claim 10, further comprising: connecting a compensator to a cavity in which the electronic section is provided and the compensator is configured to negate a differential pressure between an ambient subsea pressure and a pressure inside the cavity.

12. The method of claim 8, further comprising: attaching to the removable section a connection device configured to be connected to a remotely operated vehicle for being removed from the fixed part.

13. A method for assembling a control module having a fixed part and a removable section, the method comprising:

connecting a first base to a valve manifold that houses a hydraulic activated valve to form the fixed part;

connecting a second base to an electrically activated valve to form the removable section;

configuring the removable section to detachably attach to the fixed part;

configuring the hydraulic activated valve of the fixed part to be actuated by the electrically activated valve when the removable section is mated to the fixed part;

providing all functional connections between the fixed part and the removable section such that all functional connections are provided between a flat first surface of the fixed part and a flat second surface of the removable section; and configuring the fixed part to receive electrical signals from a multiplexer pod.

14. The method of claim 13, further comprising: attaching the control module to a blowout preventer stack.

15. The method of claim 13, further comprising: attaching the control module to a lower marine riser package that is configured to be removably attached to a blowout preventer stack.

* * * * *